US009485811B1

(12) United States Patent
Sansom

(10) Patent No.: US 9,485,811 B1
(45) Date of Patent: Nov. 1, 2016

(54) SPRAY BOTTLE WARMING SYSTEM

(71) Applicant: E. Dean Sansom, Mobile, AL (US)

(72) Inventor: E. Dean Sansom, Mobile, AL (US)

( * ) Notice: Subject to any disclaimer, the term of this patent is extended or adjusted under 35 U.S.C. 154(b) by 359 days.

(21) Appl. No.: 14/220,164

(22) Filed: Mar. 20, 2014

(51) Int. Cl.
*H05B 3/68* (2006.01)
*H05B 3/02* (2006.01)

(52) U.S. Cl.
CPC ..... *H05B 3/68* (2013.01); *H05B 3/685* (2013.01); *H05B 2213/05* (2013.01)

(58) Field of Classification Search
CPC ..... H05B 3/68–3/683; H05B 3/74–3/748; H05B 3/76; H05B 2213/05
USPC ..... 219/443.1–448.11, 518
See application file for complete search history.

(56) References Cited

U.S. PATENT DOCUMENTS 3,586,824 A * 6/1971 Barney ..... H05B 3/683 219/433
3,892,945 A 7/1975 Lerner
3,908,111 A * 9/1975 Du Bois ..... A47J 37/1209 219/432
4,003,388 A * 1/1977 Nopanen ..... A45D 20/08 219/222
4,463,664 A 8/1984 Peace
4,476,946 A * 10/1984 Smith ..... G01G 3/1402 177/144
5,960,998 A 10/1999 Brown
6,075,229 A 6/2000 Vanselow
6,403,928 B1 6/2002 Ford
6,444,956 B1 9/2002 Witcher et al.
6,870,137 B1 3/2005 Clapp
7,067,772 B2 * 6/2006 Tanner ..... A61L 9/03 219/443.1
2011/0062149 A1 3/2011 Driel et al.

* cited by examiner

*Primary Examiner* — Sang Y Paik
(74) *Attorney, Agent, or Firm* — Peter Loffler

(57) ABSTRACT

A spray bottle warming system warms the liquid contents held within a spray bottle used in a hair cutting or styling salon. The device uses a housing that has a bottom and a base plate such that one or more heating coils are located either underneath or passing through the base plate. A sidewall of the housing forms an annular lip with an opening therebetween with the spray bottle resting on the base plate and secured by the annular lip and heated via the heating coils. The device is capable of sensing the weight of the spray bottle, either absolutely, or relative to an initial starting weight, so that the output of the heating coils is controlled by the weight sensed, the less weigh sensed, and thus the less contents within the bottle, the less heat output from the heating coils.

8 Claims, 4 Drawing Sheets

SPRAY BOTTLE WARMING SYSTEM

BACKGROUND OF THE INVENTION

1. Field of the Invention

The present invention relates to a warming system to warm the contents of a spray bottle used in the hair care industry.

2. Background of the Prior Art

Getting a haircut is one of life's little chores that most people must perform several times a year. While a few people despise going to get a haircut, especially the younger set, many people actually enjoy the experience. You get to sit in a very comfortable chair while a skilled barber or stylist combs through your hair and cuts it to the desired length and style, often preceded by a gentle shampoo and rinse. The experience is comfortable and relaxing and upon completion, one's hair looks better and the person feels better.

One complaint often heard at salons and barbershops revolves around the water sprayed on a person's head during the cutting of the hair. Water or other styling liquid is sprayed onto the hair from a spray bottle in order to keep the hair flat and thus make the hair easier to manipulate and cut. The water is sprayed from a typical spray bottle that sits on the counter along with the stylist's other tools. As such, the liquid is at room temperature throughout the day, which temperature tends to feel too cold for many patrons.

Many high end salons eliminate this discomfort by making sure that the water or other liquid in the spray bottle is at a temperature above room temperature, typically in the low 90s degrees Fahrenheit. This is done by replenishing the liquid prior to each customer with water that comes from the tap at a warm temperature or otherwise heating the liquid and pouring the heated liquid into the spray bottle. While effective, such liquid heating is quite labor intensive and is typically performed only at higher cost salons and style shops.

What is needed is a simple, low-cost, low labor intensive way to keep a liquid in a stylist's spray bottle at an elevated temperature so as to add comfort to the overall experience of a patron at a hair cutting salon. Such a device must be able to keep the liquid within the spray bottle at a temperature that is comfortable when sprayed on a human's skin, especially around the head and neck area, without unnecessary involvement from the stylist or other salon personnel.

SUMMARY OF THE INVENTION

The spray bottle warming system of the present invention addresses the aforementioned needs in the art by providing a device with receives a stylist's liquid spray bottle thereonto and keeps the liquid therein at a human skin contacting comfortable temperature so that when the liquid is sprayed onto a client's head or neck during a cutting or styling procedure, the client finds comfort with the experience. The spray bottle warming system is a relatively simple device that is of relatively simple design making the device relatively inexpensive to produce, using standard manufacturing techniques. This makes the spray bottle warming system economically attractive to potential consumers of such a device. The spray bottle warming system has optional means to keep the temperature of the liquid within the spray bottle in a relatively narrow temperature range, irrespective of the amount of liquid held within the spray bottle.

The spray bottle warming system is comprised of a housing that has a bottom and a sidewall rising above the bottom, the sidewall forming an annular lip. A base plate is held within the housing such that the spray bottle sits atop the base plate within an opening formed by the annular lip. A heating coil is located beneath or within the base plate for heating of the base plate, with the base plate transferring heat to the spray bottle. The heating coil is connected to a source of electric power. A switch is provided for controlling the spray bottle warming system by a user and a circuit board is provided for controlling the functioning of the spray bottle warming system and each is electrically connected to the heating coil for controlling the output of the heating coil. The switch includes the ability to turn the heating coil on and off and to vary the intensity of the output of the heating coil. A timer may be electrically connected to the heating coil for switching the heating coil off after an elapsed amount of time has expired after the heating coil is switched on which elapsed amount of time is variable. The spray bottle warming system may come equipped with a weight sensing means that is connected to the base plate for sensing the weight load upon the base plate (the spray bottle and its contents) and varying the output of the heating coil based on the weight load detected, the less weight sensed, the less heat output by the heating coil. The weight sensing means may comprise a weight sensor electrically connected to the circuit board wherein the weight sensor sends an electric signal indicating the detected weight load, and the circuit board adjusting the heating coil's output accordingly. Alternately, the weight sensing means may comprises a contact located on the base plate and a contact plate located on an inner surface of the sidewall of the housing such that the contact is electrically connected to the contact plate and capable of sliding along the contact plate, thereby forming a linear electric switch. A spring is disposed between the bottom of the housing and the base plate, allowing the base plate to vary its height above the bottom based on the weight load upon the base plate, such that the varying of the height of the base plate above the bottom changes the relative position of the contact along the contact plate, such that the respective position of the contact along the contact plate determines the heating output of the heating coil, the higher the relative position of the base plate relative to the bottom, the less relative output from the heating coil as the weight load on the base plate is relatively lighter indicating that the spray bottle has relatively fewer contents and thus needs less heat to keep the contents at the desired temperature.

BRIEF DESCRIPTION OF THE DRAWINGS

Similar reference numerals refer to similar parts throughout the several views of the drawings.

DESCRIPTION OF THE PREFERRED EMBODIMENT

Figure 1:
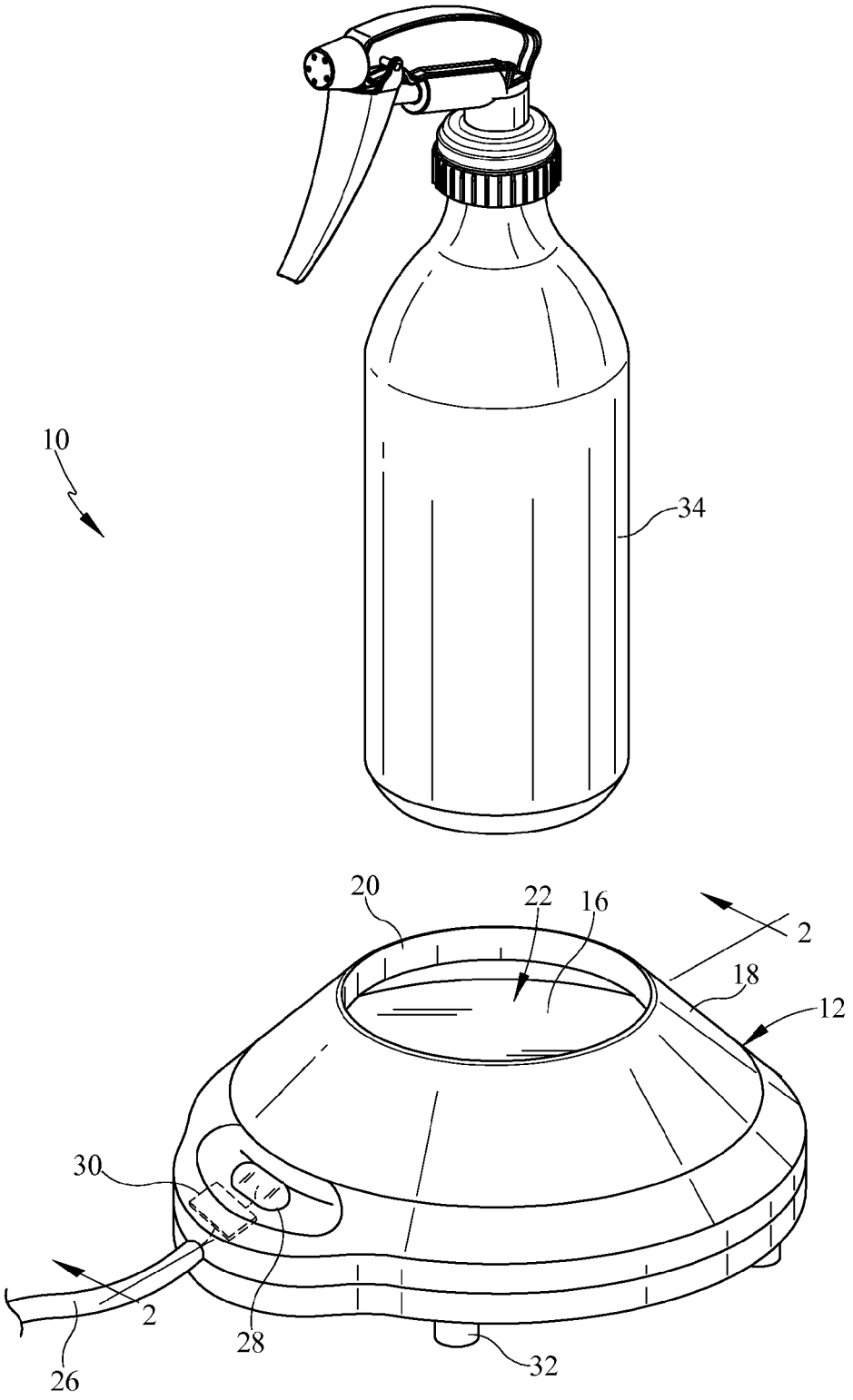
FIG. 1 is a perspective view of the spray bottle warming system of the present invention.

Referring now to the drawings, it is seen that the spray bottle warming system of the present invention, generally denoted by reference numeral 10, is comprised of a housing 12 that has a bottom 14 and that also has a base plate 16 held within the housing 12 with a sidewall 18 of the housing 12 extending upwardly (and possibly inwardly) above the base plate 16 in order to form an annular lip 20 with an opening 22 therebetween. One or more heating coils 24 are located underneath or within the base plate 16. The heating coils 24 are electrically connected to an electric cord 26 that is plugged into a source of electric power, such as a typical wall socket (not illustrated). One or more control switches 28 are electrically disposed between the heating coils 24 and the source of electric power via the electric cord 26 in order to control the heating coils 24. A circuit board 30 is also connected to the switches 28 and the heating coils 24 to control the functionality of the heating coils 24. The switches 28 may be as simple as an on/off switch or may be more elaborate by having a temperature control switch (either as part of the on/off switch or as a separate switch). The switches 28 may also have a timer for automatically turning off the heating coils 24 after an elapsed amount of time. Such a timer may be automatic, such as being within the switching circuitry of the circuit board 30 or may be a manually controllable switch. The switches 28 may be basic analog switches or may be digital switches. A display window (not illustrated) may be provided for showing the status of the spray bottle warming system 10.

Appropriate legs 32 may extend downwardly from the bottom 14 of the housing 12 in order to allow the housing 12 to properly seat onto a surface such as a counter at a salon.

In this basic configuration of the spray bottle warming system 10, a spray bottle 34 is filled with a desired liquid, such as water, and the spray bottle warming system 10 is activated via one of the switches 28. The bottom of the spray bottle 34 is placed into the housing 12 and the heating coils 24 are energized via the switches 28. The spray bottle 34 is held in place via the annular lip 20 of the housing 12. If such functionality is provided, the desired intensity of the heating coils 24 is set via the appropriate switch 28, and if also if such functionality is provided, the timer is set via the appropriate switch 28 if user controlled. As the heating coils 24 become warmer, they transfer heat to the base plate 16 which transfers heat to the spray bottle 34 thereby heating the liquid held therein. If such functionality is provided, the precise heating of the spray bottle 34 contents is controlled via the temperature control switch 28.

In a more sophisticated configuration of the spray bottle warming system 10, the temperature of the heating coils 24 is varied based on the amount of liquid held within the spray bottle 34 so that as the spray bottle 34 becomes partially depleted of its liquid cargo during use throughout the hair cutting and styling day, the output of the heating coils 24 is automatically lowered in order to transfer less heat to the spray bottle 34, otherwise, the liquid within the spray bottle 34 can become hotter than desired with the potential to cause discomfort or even a burn to the client.

Such automatic temperature control of the heating coils 24 is accomplished by determining the weight of the spray bottle 34 and its contents. The less the spray bottle 34 weighs, the less liquid held therein, and the less heat output is needed from the heating coils 24 in order to maintain the liquid within the spray bottle 34 at a desired temperature.

Weight sensing of the spray bottle 34 can be accomplished in one of two main methods.

Figure 2:
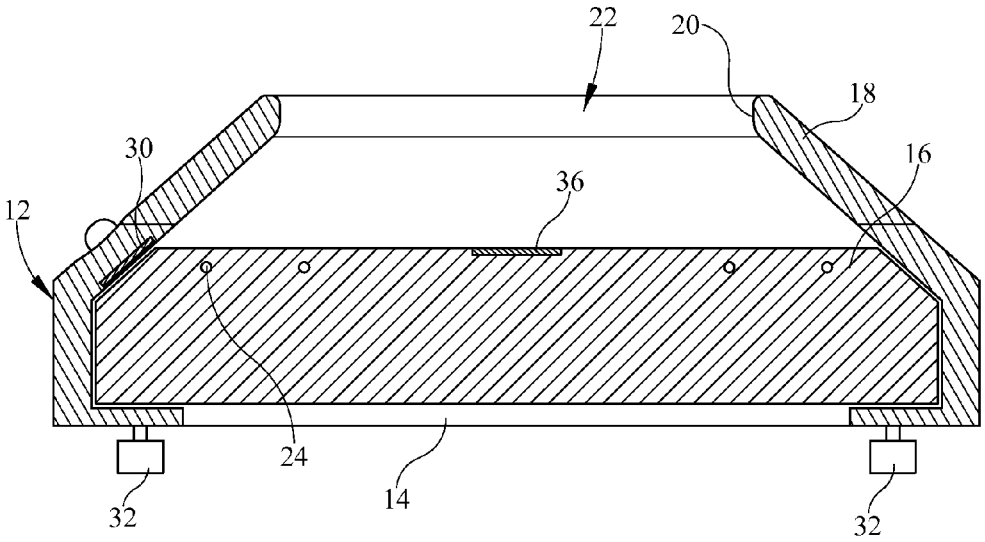
FIG. 2 is a sectioned view of the spray bottle warming system taken along line 2-2 in FIG. 1.

As seen in FIGS. 1 and 2, an electronic weight sensor 36 of any appropriate design known in the art is positioned on an appropriate location of the base plate 16. The weight sensor 36 detects the weight of the spray bottle 34 and its contents and sends an appropriate signal to the circuit board 30 which varies the heat output of the heating coils 24 based on the input the circuit board 30 receives from the weight sensor 36. The less weight sensed by the weight sensor 36, the less heat output generated by the heating coils 24 as dictated by the circuit board 30 via appropriate signals sent by the circuit board 30 to the heating coils 24. The spray bottle warming system 10 can be designed so that the circuit board 30 uses an absolute weight signal sent by the weight sensor 36 to control the heating coils 24, or the spray bottle warming system 10 can take an initial tare reading when switched on and a spray bottle 34 is placed into the housing 12 and thereafter have the circuit board 30 generate control signals to the heating coils 24 based on the relative weight readings from the baseline initial tare. If no weight is detected by the weight sensor 36, the spray bottle warming system 10 can turn the heating coils 24 off, after an elapsed amount of time.

Figure 3:
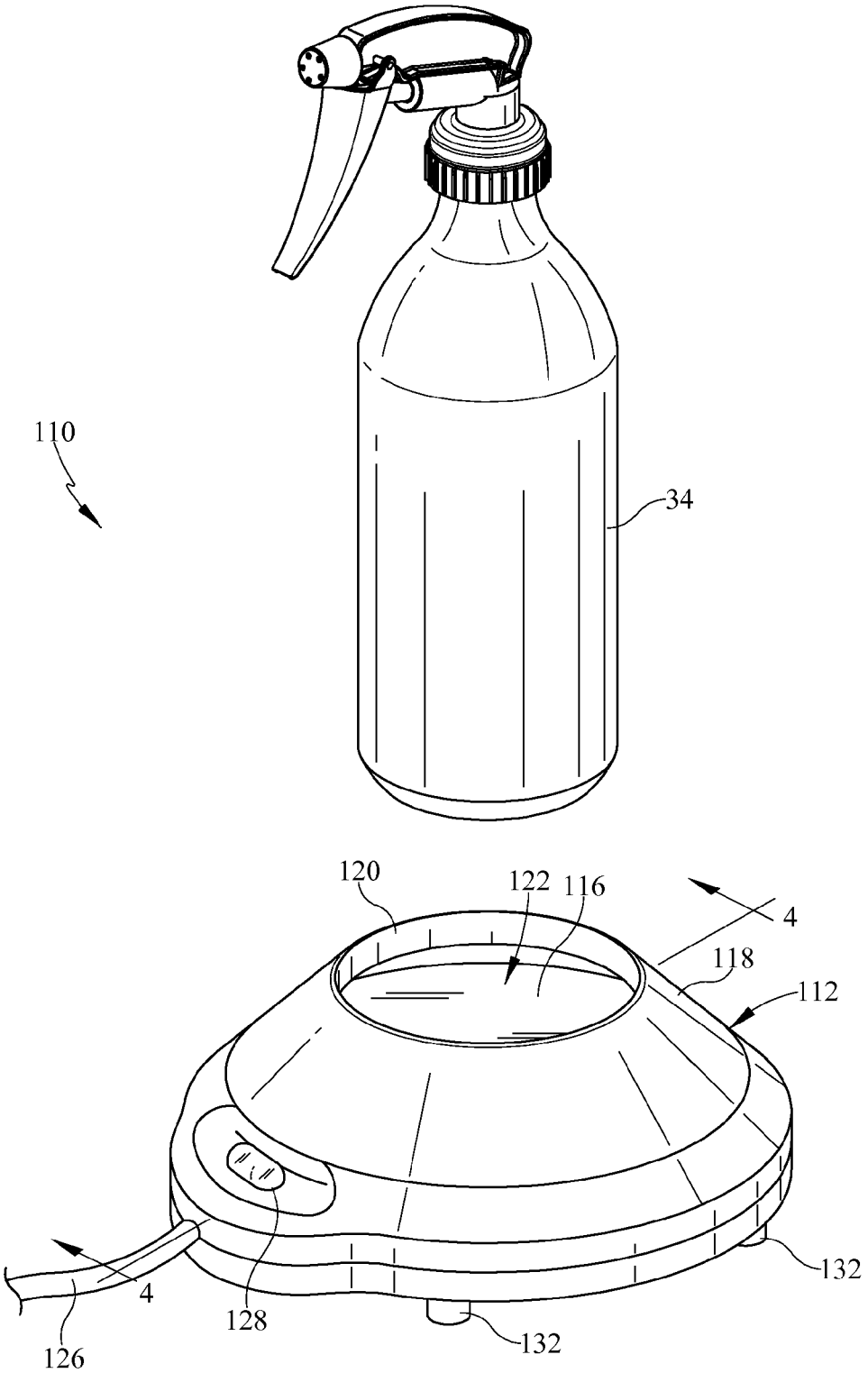
FIG. 3 is a perspective view of an alternate embodiment of the spray bottle warming system of the present invention.
Figure 4:
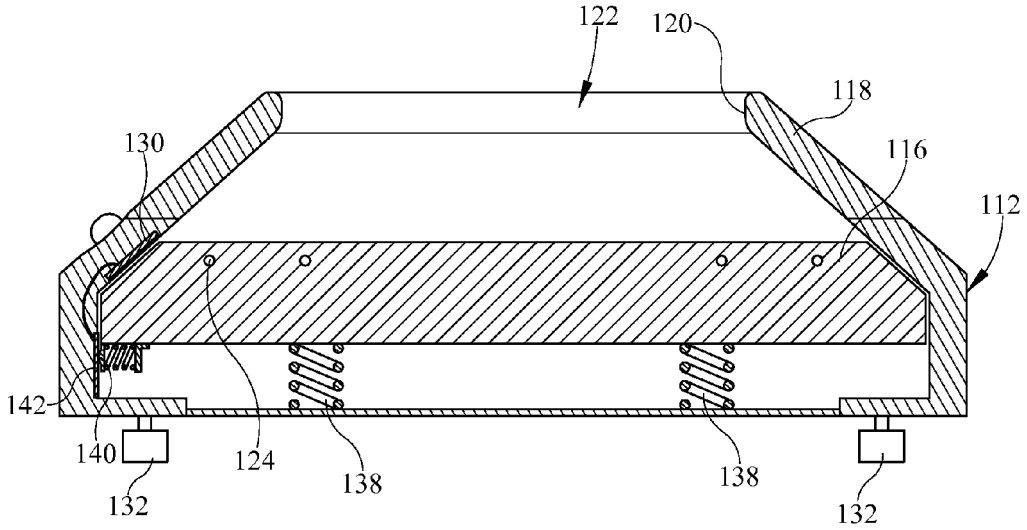
FIG. 4 is a sectioned view of the spray bottle warming system taken along line 4-4 in FIG. 3.

Alternately, as seen in FIGS. 3 and 4 in an alternate embodiment of the spray bottle heating system 110 of the present invention is comprised of a housing 112 that has a bottom 114 and that also has a base plate 116 held within the housing 112 with a sidewall 118 of the housing 112 extending upwardly (and possibly inwardly) above the base plate 116 in order to form an annular lip 120 with an opening 122 therebetween. One or more springs 138 bias the base plate 116 against the bottle 114 of the housing 112 so that the base plate 116 is capable of moving up and down, depending on how much weight the base plate 116 is supporting. One or more heating coils 124 are located underneath or within the base plate 116. The heating coils 124 are electrically connected to an electric cord 126 that is plugged into a source of electric power, such as a typical wall socket (not illustrated). One or more control switches 128 are electrically disposed between the heating coils 124 and the source of electric power via the electric cord 126 in order to control the heating coils 124. A circuit board 130 is also connected to the switches 128 and the heating coils 124 to control the functionality of the heating coils 124. The switches 128 may be as simple as an on/off switch or may be more elaborate by having a temperature control switch (either as part of the on/off switch or as a separate switch). The switches 128 may also have a timer for automatically turning off the heating coils 124 after an elapsed amount of time. Such a timer may be automatic, such as being within the switching circuitry of the circuit board 130 or may be a manually controllable switch. The switches 128 may be basic analog switches or may be digital switches. A display window (not illustrated) may be provided for showing the status of the spray bottle warming system 110.

Appropriate legs 132 may extend downwardly from the bottom 114 of the housing 112 in order to allow the housing 112 to properly seat onto a surface such as a counter at a salon.

A contact 140 is located on the base plate 116 while a contact plate 142 is located on the inner surface of the sidewall 118 of the housing 112, the contact 140 and the contact plate 142 acting as a linear switch that is electrically connected to the heating coils 124, either directly or via the circuit board 130. If the linear switch is connected directly to the heating coils 124, then the linear switch is a mechanical resistive switch that varies the electrical resistance going to the heating coils 124 from the source of electric power. Whenever the base plate 116 is relatively higher above the bottom 114 of the housing 112 (less weight in the spray bottle 34), then the linear switch is more resistive so that less heat is generated by the heating coils 124, and vice versa. Alternately, the linear switch may be a digital switch that sends is position to the circuit board 130, with the signal received by the circuit board 130 causing the circuit board 130 to control the heating coils 124 as appropriate. In this way, as liquid is depleted from the spray bottle 34, the base plate 116 rises higher relative to bottom 114 of the housing 112 via the spring 138 bias, and therefore, less heat is generated by the heating coils 124.

While the invention has been particularly shown and described with reference to embodiments thereof, it will be appreciated by those skilled in the art that various changes in form and detail may be made without departing from the spirit and scope of the invention.

I claim:

1. A device to warm a spray bottle, the device comprising:
a housing having a bottom and a sidewall rising above the bottom, the sidewall forming an annular lip;
a base plate held within the housing such that the spray bottle sits atop the base plate within an opening formed by the annular lip;
a heating coil located beneath or within the base plate for heating of the base plate, the heating coil connected to a source of electric power;
a switch and a circuit board each electrically connected to the heating coil for controlling the output of the heating coil;
a contact located on the base plate;
a contact plate located on an inner surface of the sidewall of the housing, the contact electrically connected to the contact plate and capable of sliding along the contact plate; and
wherein a spring is disposed between the bottom of the housing and the base plate, allowing the base plate to vary its height above the bottom, such that the varying of the height of the base plate above the bottom changes the relative position of the contact along the contact plate, such that the respective position of the contact along the contact plate determines the heating output of the heating coils.

2. The device as in claim 1 wherein the switch includes the ability to turn the heating coil on and off and to vary the intensity of the output of the heating coil.

3. The device as in claim 2 further comprising a timer electrically connected to the heating coil for switching the heating coil off after an elapsed amount of time has expired after the heating coil is switched on.

4. The device as in claim 3 wherein the elapsed amount of time of the timer is variable.

5. A device to warm a spray bottle, the device comprising:
a housing having a bottom and a sidewall rising above the bottom, the sidewall forming an annular lip;
a base plate held within the housing such that the spray bottle sits atop the base plate within an opening formed by the annular lip;
a heating coil located beneath or within the base plate for heating of the base plate, the heating coil connected to a source of electric power;
a switch and a circuit board each electrically connected to the heating coil for controlling the output of the heating coil;
a contact located on the base plate; and
a contact plate located on an inner surface of the sidewall of the housing such that the contact is electrically connected to the contact plate and capable of sliding along the contact plate and wherein a spring is disposed between the bottom of the housing and the base plate, allowing the base plate to vary its height above the bottom, such that the varying of the height of the base plate above the bottom changes the relative position of the contact along the contact plate, such that the respective position of the contact along the contact plate determines the heating output of the heating coils.

6. The device as in claim 5 wherein the switch includes the ability to turn the heating coil on and off and to vary the intensity of the output of the heating coil.

7. The device as in claim 5 further comprising a timer electrically connected to the heating coil for switching the heating coil off after an elapsed amount of time has expired after the heating coil is switched on.

8. The device as in claim 7 wherein the elapsed amount of time of the timer is variable.

* * * * *